US012734425B2

(12) United States Patent
Huc et al.

(10) Patent No.: US 12,734,425 B2
(45) Date of Patent: Sep. 15, 2026

(54) CONNECTED DEVICE TO BE FITTED TO A PUNCHING BAG

(71) Applicant: INFO EVOLUTION, Appelle (FR)

(72) Inventors: Maryline Huc, Appelle (FR); Olivier Huc, Appelle (FR)

(73) Assignee: PERCUT, Appelle (FR)

( * ) Notice: Subject to any disclaimer, the term of this patent is extended or adjusted under 35 U.S.C. 154(b) by 36 days.

(21) Appl. No.: 18/259,994

(22) PCT Filed: Dec. 22, 2021

(86) PCT No.: PCT/IB2021/062172
§ 371 (c)(1),
(2) Date: Jun. 29, 2023

(87) PCT Pub. No.: WO2022/172078
PCT Pub. Date: Aug. 18, 2022

(65) Prior Publication Data

US 2024/0066375 A1 Feb. 29, 2024

(30) Foreign Application Priority Data

Feb. 15, 2021 (FR) ..... 2101400

(51) Int. Cl.
*A63B 69/32* (2006.01)
*A63B 69/20* (2006.01)
*A63B 71/06* (2006.01)

(52) U.S. Cl.
CPC ..... *A63B 69/32* (2013.01); *A63B 69/305* (2022.08); *A63B 71/0622* (2013.01);
(Continued)

(58) Field of Classification Search
None
See application file for complete search history.

(56) References Cited

U.S. PATENT DOCUMENTS 9,782,652 B2 10/2017 Williamson
9,931,539 B1 4/2018 De Pablos et al.
(Continued)

FOREIGN PATENT DOCUMENTS

CA 2945293 A1 4/2017
FR 2757410 A1 6/1998
(Continued)

OTHER PUBLICATIONS

International Search Report w/English translation for PCT/IB2021/062172 mailed Mar. 10, 2022, 6 pages.
(Continued)

*Primary Examiner* — Shila Jalalzadeh Abyaneh
(74) *Attorney, Agent, or Firm* — CRGO Global; Steven M. Greenberg

(57) ABSTRACT

Disclosed is a device to be fitted to a punching bag, including: a cover which can contain the punching bag and formed of two sheaths, an inner sheath and an outer sheath, placed on top of one another, and including a releasable fastener to the punching bag; a plurality of target elements attached between the sheaths, each element including at least one pressure sensor electrically connected to an electronic control unit which includes a unit receiving data from the pressure sensors and a unit for processing the data; and an external system including a unit for communicating with the electronic control unit, a unit for analyzing the received data and a recording unit, storing and outputting the data and analyses. The targets may include light emitters controlled by the external system. Also disclosed is a connected punching bag and an interactive assembly for assisting in combat sports training.

10 Claims, 3 Drawing Sheets

(52) U.S. Cl.
CPC ... *A63B 2071/0625* (2013.01); *A63B 2209/10* (2013.01); *A63B 2220/53* (2013.01); *A63B 2220/56* (2013.01); *A63B 2220/58* (2013.01); *A63B 2220/833* (2013.01); *A63B 2225/50* (2013.01); *A63B 2225/74* (2020.08)

(56) References Cited

U.S. PATENT DOCUMENTS

| | | | | |
|---|---|---|---|---|
| 10,213,672 | B2 | 2/2019 | Codrington | |
| 10,974,119 | B1 * | 4/2021 | Julian | A63B 69/305 |
| 2009/0048069 | A1 * | 2/2009 | Sheedy | A63B 24/0006 482/8 |
| 2014/0366645 | A1 * | 12/2014 | Tsai | G01L 5/0052 73/862.041 |
| 2015/0094191 | A1 * | 4/2015 | Fradin | A63B 71/0622 482/8 |
| 2015/0258374 | A1 * | 9/2015 | Helanto | A63B 69/322 482/84 |
| 2016/0059102 | A1 * | 3/2016 | Williamson | A63B 69/32 482/8 |
| 2016/0074734 | A1 * | 3/2016 | Tsai | A63B 24/0062 482/8 |
| 2016/0175678 | A1 * | 6/2016 | Branch | A63B 69/32 482/84 |
| 2019/0388760 | A1 * | 12/2019 | Morin | A63B 69/32 |

FOREIGN PATENT DOCUMENTS

| | | | | |
|---|---|---|---|---|
| FR | 3052984 | A1 | 12/2017 | |
| GB | 2552362 | A * | 1/2018 | A63B 24/0021 |
| KR | 20200026023 | A * | 3/2020 | |
| WO | 2013040416 | A2 | 3/2013 | |
| WO | 2013192344 | A2 | 12/2013 | |

OTHER PUBLICATIONS

Written Opinion of the ISA for PCT/IB2021/062172 mailed Mar. 10, 2022, 6 pages.

* cited by examiner

CONNECTED DEVICE TO BE FITTED TO A PUNCHING BAG

CROSS-REFERENCE TO RELATED APPLICATIONS

This application is the US national stage of PCT/IB2021/062172, filed Dec. 22, 2021, which claims the priority of FR FR2101400, filed Feb. 15, 2021, the entire contents of each foregoing application incorporated herein by reference.

BACKGROUND OF THE INVENTION

Field of the Invention

The present invention relates to the field of equipment for physical sports exercise and relates more specifically to punching bags used for combat sports training.

It aims for an accessory presented as a cover which can cover a traditional punching bag, to which pressure sensors are attached in flexible sheets, associated with an electronic system, the assembly making it possible for a user to have quantified data relating to hits taken by the bag. Another aim of the invention is a punching bag fitted with said device. An assembly for assisting in combat sports training is also claimed, comprising one or more connected and interactive punching bags.

Description of the Related Art

Practices referenced under the name of boxing form part of the striking combat sports category focusing on punching techniques. In particular, English boxing, American boxing, French boxing often called "savate", kickboxing, Chinese women's boxing, or also freestyle combat and pankration can in particular be mentioned, which combine striking and gripping techniques. Karate or taekwondo practiced as sports activities, are also striking disciplines. These numerous variants are defined by their body targets (face, chest, legs, etc.) and by the body weapons used: according to the disciplines, hits can be executed with the upper limbs (fist, elbow) or with the lower limbs (foot, knee).

Generally, during sports meetings and competitions, two fighters face each other in a duel and attempt to neutralize the opponent by effective and accurate hits. It is clear that learning these technical moves and physical training cannot be done under real conditions but is greatly based on exercises including punching sessions on non-human targets. In this regard, the boxing bags (or punching bags) fulfil an important function in sports training.

Punching bags, whether they are static or dynamic, are commonly presented in the form of a cylindrical body upholstered with a damping material, which is covered with a thick leather or textile material envelope, provided with a high resistance to repeated hits. The bag can be self-supporting, and in this case, it is mounted on a heavy base ensuring the stability of the equipment, with or without articulation. The bag can, on the contrary, be suspended by a chain on a bracket, with an integrated ballast, ensuring a good stability of the bag when powerful punches are taken.

Professional or amateur sportspeople who seek to improve their level and to improve their technique by using such punching bags, want to be able to control the effectiveness of their hits in terms of accuracy, power, or also speed. For that, it is useful to be able to view in real time, and/or analyze retrospectively, the training sessions, based on the objective database, in order to quantify necessarily subjective feelings and to consequently adapt the sessions to improve performance.

Different systems have been proposed to respond to this request, where sensors are placed in a punching bag. For example, document FR 2757410 describes a punching bag, wherein a curved plate is integrated, supporting deformation detectors on its inner face, for example extensometer sensors. The detectors are connected to an electronic system which can transmit the signals emitted under the effect of the impacts and to record them in the memory of a computerized system. Coming from the session, the sportsperson can view the data collected, such as the amplitude, the position and the number of hits taken on the target. This system requires a prior calibration.

WO2013/040416 describes equipment comprising a panel on which buffers serving as targets to be hit according to a pre-established sequence are placed. Arms extending on either side of the panel are connected to the buffers and can also be hit. Each buffer is connected to an impact detector composed of an accelerometer and a signal processing tool. The data are collected by a control unit and sent onto a screen, for an analysis of the training session. Although it is presented as intended for boxing and martial arts training, this equipment in reality falls under a reflex game. It is not adapted to training according to the rules of boxing.

In CA 2945293, a cylindrical punching bag is described, which comprises a plurality of impact detectors such as accelerometers, which are mounted along a support occupying the longitudinal axis of the bag. Different zones featuring an opponent are represented in color on the envelope of the bag to orient the hits. The signals generated by the impacts are managed by an electronic analysis system and relayed via a wireless connection to an interface which can be read by the user, who can be aware of the parameters of their session (quantity and power of the hits).

All this equipment dedicated to training is provided with a set of sensors which can be arranged in a network, and an electronic system transmitting the data collected by the sensors to a central unit. The sensors can be of different types, mentioned for example in WO2013/192344: gyroscopes, accelerometers, magnetic field detectors. Cables or piezoelectric sheets can also be used, incorporated inside the target structure. The electronic systems of this equipment transmit the data obtained to a central unit (processor or microprocessor) which is configured to provide the user with an objective report of their session. Numerous software applications are moreover described, aiming to process various parameters of data and to display the results.

With the development of communication technologies, multiple usage functionalities are now available. These integrate the option of comparing several sessions to one another, to view training programs or to adapt them as desired. Moreover, interactive systems have appeared. In this case, the equipment can itself receive instructions from the central unit, so as to emit a light or sound signal when the time between two hits is too long, that the impact has an insufficiently power, or other, etc. For example, in WO2013/192344, an interactive training system is described, wherein sensors attached to a punching bag can collect data relating to the hits taken at the target, in particular the force of the impacts, their orientation, or the reaction time. The system can be configured, such that successive light signals are emitted at the places of the bag where the user must hit, according to a training sequence prerecorded in the central unit.

The connected punching bags described above are designed as integrated equipment i.e. wherein the sensors are incorporated in the structure of the bag. Furthermore, the sensors are placed in the central position or at least at a distance from the external surface of the bag. This arrangement has several disadvantages. Indeed, the detector elements are fragile by nature, especially since they are subjected to repeated impacts, while the body of the bag is designed to sustainably resist assaults from boxers. The detector elements, even if they are covered with a thick padding, are therefore able to prematurely break down. Also, the cables ensuring the electrical connections can be disconnected. Their distribution requires accessing the internal structure, which is awkward, even impossible without damaging the bag. Due to this, a malfunctioning of the detection and data transmission members can lead to replacing all of the punching bags. Moreover, the accuracy in the perception of impacts by the sensors buried in a padding thickness and under an outer envelope, is problematic.

Another disadvantage is that it is not possible to modify the placement of the sensors according to the target zones of the hits which can differ from one discipline to another, or according to the pattern of exercises to carry out.

Furthermore, the acquisition of such connected bags imposes a significant investment. Indeed, a sportsperson who wants to benefit from a report of their training, or be guided by an interactive system, must purchase a complete punching bag, integrating the sensors and the associated electronic system. Boxing clubs already have conventional punching bags and do not have the means to acquire new apparatus, which is clearly more expensive.

There is therefore a need to have striking sports training equipment, making it possible for those taking part to benefit from the functionalities of the connected punching bags mentioned above, which is robust, easy to maintain and inexpensive.

SUMMARY OF THE INVENTION

In response to this need, the applicant has developed an accessory which can cover a traditional punching bag, to which are assembled all the necessary members to detect the impacts received on the bag and transmit the signals generated to a processor. This accessory is presented as a cover of a similar shape to the bag that it must cover and be composed of two flexible sheaths placed on top of one another, between which sensor elements in flexible sheets are attached. The cover can be put on the punching bag and be removed without difficulty to carry out its maintenance or repair faulty elements. The cover and its flexible sensors fully mold the shape of the punching bag, without impeding the user.

Thus, an aim of the present invention is to offer a device making it possible to transform a common-type punching bag, into a connected punching bag which can detect hits, to analyze different significant parameters, and to transmit the results to a processor. Another aim is to have equipment which is practical to install, to remove and to maintain. A device is particularly sought, which can be easily exchanged or repaired. Another aim of the present invention is to enable the user or their trainer to have quantified data and parameters, not only after each session, but also in real time during the exercise, by a visible or audible display. Also, an aim of the present invention is to propose an accessory which can emit visible or audible signals guiding the user in their exercises, and consequently, which can receive commands from the central unit to offer assistance to training. Another aim of the invention is to propose an accessory of format adapted to any types of boxing bags, which is practical to use, solid and accessible to all for a moderate cost price.

The disadvantages stated above are resolved and the aims above are achieved, thanks to the present invention aiming for equipment comprising a connected and interactive, removable punching bag cover.

More specifically, according to a first aspect, the present invention aims for a device intended to be fitted in a punching bag for striking combat sports training, comprising a cylindrical body covered with an envelope and means for attaching in a vertical position, the device comprising:

- a cover which can contain said punching bag, the cover being formed of two sheaths, one inner and one outer, placed on top of one another, and comprising means for releasably fastening to said punching bag,
- a plurality of target elements attached between the two sheaths, each comprising at least one pressure sensor electrically connected to an electronic control unit,
- said electronic control unit comprising means for receiving data coming from each of the sensors and means for processing said data,
- an external system comprising means for analyzing data received from the electronic control unit, means for recording, storing and outputting said data and the results from said analyses,
- means for communicating between the electronic control unit and the external system,
- means for electrically powering the electronic control unit and the external system.

The inventive device first comprises a cover designed to be fitted in a boxing bag of the known type, which sportspeople hit, the mainly cylindrical body of which is covered with a protective envelope. The cover according to the invention, which is independent of the bag that it is designed to be fitted in and intended to be put on above the envelope of the punching bag without modifying any of the latter, therefore also has a cylindrical (or tubular) shape, and dimensions defining an inner volume which can contain said punching bag. This shaping is generally done when the cover contains the punching bag, as preferably, it is flexible by the materials which constitute it, as will be seen below. The flexible character means that it can be plastically deformed with a minimum force, for example, under the effect of its own weight, like a fabric does.

The cover comprises means for releasably fastening to the punching bag, such that it is removable, i.e. that it can be installed and held to the bag, then removed as needed, simply and rapidly, without using a tool. It is open at one of its ends (or at both ends). Practically, an end if closed by a circular bottom attached to the tubular sheath, while the other end is provided with a link or another adjustable tightening means, to securely fix the cover to the punching bag, and releasable such that the cover preserves its removable character and can be removed immediately as desired.

Thus, according to a feature of the device, which is the subject matter of the invention, the cover comprises a tubular body of diameter which is substantially identical to the diameter of the punching bag for which it is intended, at least one end of which is open and provided with a means for releasably fastening the cover to the punching bag.

The cover comprises two sheaths, one inner and one outer, inserted in one another so as to produce a "double skin". The inner sheath is in contact with the envelope of the punching bag, while the outer sheath which covers it all, can be seen by the user. Advantageously, the sheaths are made of flexible and slightly resilient materials, for a perfect match to the shape of the punching bag. For example, woven or knitted (jersey) textile materials can be used, or materials usually used in furnishings like natural leathers or synthetic leathers (faux leather, coated fabric, etc.). They are further chosen to have an adequate resistance as regards the planned use. The two sheaths can be made of one single material or of two materials, even more, according to the practical or esthetic criteria that a person skilled in the art can select.

Thus, according to another feature of the device, which is the subject matter of the invention, the sheaths of the cover are made of identical or different materials, chosen from among woven textiles, knitted textiles, natural leathers or synthetic leathers.

The two sheaths on top of one another make two layers of materials, between which the target elements of the device are placed. These elements are qualified as targets, because they occupy placements at the periphery of the punching bag that the user will seek to reach by accurate and powerful hits. Each target element comprises at least one pressure sensor electrically connected to an electronic control unit. When an effective hit reaches a sensor, an electrical signal is generated and is transmitted to the electronic control unit, which records the data relating to it, in particular the position of the sensor in question, the time, or other parameters. It goes without saying that the target elements, three of them as a minimum, are disposed at suitable placements according to the type of boxing practiced. Preferably, the cover according to the invention comprises at least five target elements, and also, preferably, at least eight target elements.

The target elements are designed to be attached between the two sheaths. To do this, flexible sheet structures have been designed, incorporating the pressure sensors, also formed of flexible sheets. By flexible sheets, this means a structure having a low thickness with respect to its surface, and which be plastically deformed with a minimum force, for example under its own weight (opposed to a flexible element which has notable resilient properties). In other words, the target elements have a thickness and a flexibility which make it possible to slide them between the two sheaths without creating surface roughness or a hard zone which can impede or injure users.

Moreover, particularly preferably, the invention implements pressure sensors of the type providing a response proportional to the urging undergone, such that quantified information of the power of the hit taken is obtained.

Thus, according to the invention, the device can comprise at least three target elements structured in flexible sheets, each comprising a pressure sensor which can deliver an electrical signal proportional to the pressure exerted on it.

A preferred embodiment of the invention consists of using pressure sensors formed of a pressure-sensitive electrically conductive material film, said film being placed between two conductive sheets electrically connected to the electronic control unit. The conductive film can be of the type of which the resistance varies in inverse proportion of the pressure that it undergoes, like for example, a polyolefin film (in particular, polypropylene or polyethylene) impregnated with carbon black, which makes it electrically conductive, such as a film known under the commercial name of Velostat™ or Lingstat™. The conductive sheets can themselves be made from a thin film or of a fabric, made of conductive material or incorporating conductive materials. For example, metal films (made of aluminum or other) can be used, possibly reinforced or with a flexible frame. Also, a composite metal microfiber fabric covered with a polymer can be used. Composite sheets manufactured from copper and nickel wires, woven and buried in a thin polyester layer are particularly indicated to conciliate the flexibility and solidity qualities required. This type of material is usually used in the medical, aeronautics and space field, to absorb the magnetic radiation of appliances.

The conductive sheets are in contact with the two faces of the pressure-sensitive conductive film, over the whole of their surface. They are connected to the electronic control unit, each by a wire ensuring the electrical connection. The electronic control unit will thus be able to receive the data coming from each of the sensors (in particular, pressure, location, chronology and time interval measurements, etc.), and perform a first processing of it, as will be disclosed in detail below.

The pressure sensors included in the target elements can have different shapes and dimensions. It is understood that for reasons linked to their manufacture, regular and symmetrical shapes are preferred. Furthermore, the dimensions are calibrated with respect to the size of the weapon in play (fist, foot, elbow or knee, generally).

Thus, according to an advantageous embodiment of the invention, the pressure sensors have a round or square surface area going from 25 cm2 to 100 cm2. Preferably, the surface area is between 50 cm2 and 80 cm2, and according to a particular embodiment, it is around 64 cm2.

As seen above, the target elements are placed between the two sheaths, in suitable placements. It is advantageous to attach them to the inner sheath, the outer sheath thus serving as protection for the assembly, by a means making it possible to hold them firmly in place, but also enabling the removal of one or more of them when it is necessary to repair them or replace them.

That is why, according to the invention, the target elements are secured to the inner sheath at a distance from one another, by an attachment means chosen from among a seam, a scratch band, an adhesive, a welding, or a combination of these.

The person taking part needing to hit the different target elements to trigger a pressure measurement, while these are concealed in the cover, visually perceptible markers should be provided. According to an embodiment, patterns to be targeted can simply by printed on the outer sheath, for example in the form of targets or featuring the body of an opponent. Care will be taken to make these patterns correspond to the underlying target elements.

In a particularly interesting variant of the device, which is the subject matter of the invention, this can emit light signals having the function of the guiding the person taking part in their exercises, dynamically. The principle is to indicate in any place of the punching bag and at any time hits should be taken, by illuminating light signals according to a given sequence.

To do this, the target elements of the device which is the subject matter of the invention can each comprise at least one light emitter electrically connected to the electronic control unit. It is thus possible to illuminate these emitters according to a predetermined pattern, in order to incite the user to hit certain places of the punching bag.

In a preferred embodiment, the light emitters are light-emitting diodes (LEDs) or optical fiber segments, which can be activated by the external system via the electronic control unit.

The excitation pattern of light emitters can be controlled from the external system via the electronic control unit, according to a predefined sequence and rate, which can be chosen by the user. In practice, the external system can be configured to offer a choice of prerecorded sequences, or to generate random sequences. In the scope of these directed exercise sessions, it can be successful to compare, the pattern of a sequence with the data received from the pressure sensors, in a synchronized and localized manner, which requires that the command means of the light emitters are coupled with the means for processing the data coming from the pressure sensors.

That is why, the external system of the device according to the invention advantageously comprises means for commanding the light emitters of each of the target elements, coupled with the means for processing the data coming from the pressure sensors.

Due to the aggressive and extended use for which the inventive device is intended, it is recommended to protect, as best as possible, the target and connector elements, without limiting its ergonomic character nor by complicating the dismounting which makes it possible to rapidly intervene in case of breakdown. This is one of the reasons for which it is recommended to cover the target elements with a sheet, for example made of polymer, which will be transparent in the case where light emitters are used. Likewise, it is recommended to provide tubes, wherein electrical wires circulating between the electronic control unit and the target elements can slide. These tubes can be made of fabric, plastic material or other, and are held applied against the inner sheath of the cover. They can be directly attached to the inner sheath, for example sewn, glued, stapled, attached by a link. The tubes each coming from a target element converging towards the electronic control unit, playing both a guiding and protective role.

Thus, according to a preferred feature of the invention, the target elements are covered with a protective pocket and, for each of them, the pressure sensors and, if necessary, said at least one light emitter are connected to the electronic control unit by electrical wires which are slid in a tube held applied against the inner sheath of the cover.

According to another preferred feature of the invention, the outer sheath of the cover is provided with a compartment which can contain the electronic control unit, the tubes for holding the electrical wires being arranged converging towards said compartment. This compartment can be carefully placed inside the outer sheath so as to be located at the rear of the punching bag.

Still with the aim of enabling a rapid mounting and dismounting of the device, detachable electrical connection means are preferred in the scope of the invention. That is why, according to a variant of an embodiment, the electronic control unit is provided with at least one pin for connecting to the pressure sensors and to the light emitters, if there are any. The cables connected to the pressure sensors and those connected to the light emitters can be united in one single bundle connected by one single pin or made of two bundles connected by two distinct pins. The electronic control unit can be connected to the electrical network, but advantageously has an autonomous powering, such as a rechargeable battery. Furthermore, the connection with the external system can be ensured by a wireless technology.

Thus, according to a preferred feature of the invention, the electronic control unit can be provided with one or more of the following means:

i) of at least one pin for connecting to the pressure sensors and to the light emitters if there are any;

ii) of a wireless communication electronic module with the external system; and iii) of an autonomous powering means.

As disclosed above, the device for assisting in training according to the invention takes all of its utility due to it being related to an external system enabling the processing of different data, their transmission, their recording, and that it is also able to control the electronic control unit and to execute the functionalities and varied programs. The system is qualified as external, in that it is physically distinct from the other members composing the device (namely mainly the cover and the electronic control unit). It is, however, connected with these by communication means, which can be electrical in the case of a wired connection, but which will be most often made wireless, by electromagnetic waves. This type of equipment belongs to the category of so-called "connected" objects. It comprises a user interface which is easy to access, user-friendly and ergonomic, generally a screen and a keyboard, or a touchscreen.

Thus, according to a preferred embodiment of the device which is the subject matter of the invention, the external system is a central unit of a laptop, or a mobile phone provided with an embedded microprocessor (of the smartphone type), or a web platform, comprising means for wirelessly communicating (for example, by Bluetooth or Wi-Fi technology) with the electronic control unit, and which is configured to execute applications dedicated to assisting in striking combat sports training. Very varied applications can be designed and implemented as needed, and according to those taking part, according to their level, to their progression objectives, to the type of sport, to their personal tastes, or others.

In particular, in the scope of using the device, which is the subject matter of the invention, the external system can be configured to execute one or more applications for assisting in striking combat sports training. These can be chosen from among:

an application considering the parameters of power-speed-accuracy of each impact on one of the pressure sensors during a session;

an application considering variations of said parameters between sessions staggered over time;

an application activating the light emitters according to different sequences;

an application comparing the activation sequences of the light emitters and the parameters of power-speed-accuracy of impacts on the corresponding pressure sensors during a session;

an application for comparing the performances with a champion, other people taking part or with themselves at different times;

application providing training programs.

It will have been understood that the device described above can suit more current punching bag models. All the elements are detachable from one another and interchangeable, the cover alone needing to be adapted to the dimension of the bag to be fitted. Therefore, a conventional punching bag can be transformed, without difficulty and rapidly, into a connected punching bag by fitting it quite simply with the device described above, with a minimum bulk. The after-sales service and the possible repairs are greatly facilitated, especially since the electronic control unit or the cover (even one single target element) can be replaced separately. A function dedicated to the maintenance service can further be provided, making it possible to collect the self-control data of the punching bags and to ensure it is maintained in a good condition immediately.

That is why, according to a second aspect, the present invention aims for a punching bag for training in striking combat sports, comprising a cylindrical body covered with an envelope, and means for attaching in a vertical position, which bag is fitted with a device such as described above.

The punching bag according to the invention can comprise means for suspending to a support or maintenance means bearing on the ground. In a known manner, the suspension means can be chains, cords or other, provided with hooks engaging with a secured ring of a support (ceiling, beam, crossbar, etc.). For a bearing on the ground, there are different types of feet, ballasted or attached, with articulation, etc. The cover of the device will be adapted to consider the geometry of the bag in question, the target elements in particular needing to be disposed in suitable placements. The means for holding the cover to the punching bag will also consequently be modified. A person skilled in the art will know how to perform these adjustments without difficulty.

A conventional punching bag fitted with a device according to the invention thus becomes literally interactive. It is autonomous, personalized and fun. Furthermore, it is accessible to the greatest number of those taking part, due to its low cost.

According to a third aspect, the present invention aims for an interconnected assembly for striking combat sports training, which comprises at least two punching bags, each fitted with a device as described above, the external systems of said devices comprising remote connection means and means for synchronizing together. It is specified that the term "interconnected" expresses the fact that the different elements composing the assembly have the option of being connected together, i.e. in relation to communication, or not making use of this option.

Thanks to this arrangement, it is possible to perform interactive and bespoke individual training, as well as collective sessions. It is also possible to control several devices using a unique centralized external system, to which each user can connect. There again, the simplicity and the limited investment that the device represents, enabling each sportsperson and/or clubs to be fitted with this device, to take part in this regard.

Thus, according to a variant of an embodiment, the interconnected assembly for assisting in striking combat sports comprises at least two punching bags, each fitted with a device according to the invention, the electronic control units of said devices being provided with means for communicating with a unique centralized external system.

According to an advantageous feature, the external system(s) of said interconnected assemblies for assisting in training are configured to execute one or more interactive applications for assisting in striking combat sports training. The interactive applications can be chosen, for example, from among:

- applications for shared training of several users, side-by-side or from different places;
- accuracy, speed, power competition applications;
- sequence competition applications.

BRIEF DESCRIPTION OF THE DRAWINGS

The present invention will be best understood and details falling under this will appear in the light of the description which will be made, in relation to the accompanying figures.

DETAILED DESCRIPTION

Example 1

Figure 1:
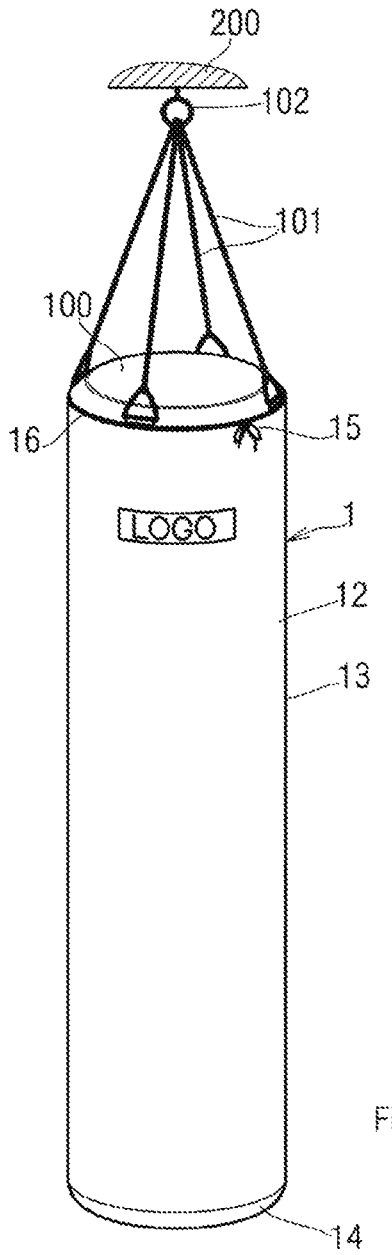
FIG. 1 is a general view of a punching bag fitted with a device according to the invention.

According to the illustrated embodiment, the device for assisting in striking combat sports training is represented in FIG. 1 fitted in a punching bag 100. The cover 1 can be seen, at least the outer sheath 22 of it, which covers the cylindrical body of the punching bag 100. The envelope of the punching bag 100 can be seen in its upper part. The bag comprises means for attaching in the vertical position, by suspension to a beam or other support 200, using three chains 101, hooked to a ring 102 of the snap hook type or other, easily removable.

The cover 1 comprises a tubular body 13 and a circular bottom 14 closing its lower end (orientation described in the use illustrated in this case). The upper end is open, while being provided with a cord 15 passing into a slider 16 making it possible to hold the cover 1 by clamping and to immediately release it as desired. The cover 1 is formed of two sheaths placed on top of one another, one inner 11 and one outer 12, represented respectively in FIG. 1 and FIG. 2. The sheaths 11, 12 are, in this case, made of stretch jersey, the inner sheath 11 being conveniently of a clear color, which facilitates sponsorship and mounting various elements during manufacture, and the outer sheath 12 being uniformly black. This sheath 12 can comprise a colored print, for example a logo or other distinctive sign, or an esthetic pattern. Another reason for choosing a uniform and dark color, is to obtain a clear contrast with a light signal emitted under the outer sheath 12, and which can be seen through meshes of the textile, as will be described below.

The two sheaths 11 and 12 are put in one another, such that the cover 1 comprises two layers placed on top of one another. They are secured together by a seam or by a scratch band, pressure buttons or other, ensuring their correct relative positioning. The tubular body 13 of the cover 1 is of a diameter which is comparable to the body of the punching bag 100, such that it molds its shape and remains flattened against it, thanks to the elasticity of the textile used. One of the sheaths comprises a compartment, wherein the electronic control unit 3 will be placed. Practically, the compartment is a pocket sewn at the top and at the rear of the outer sheath 12.

Figure 2:
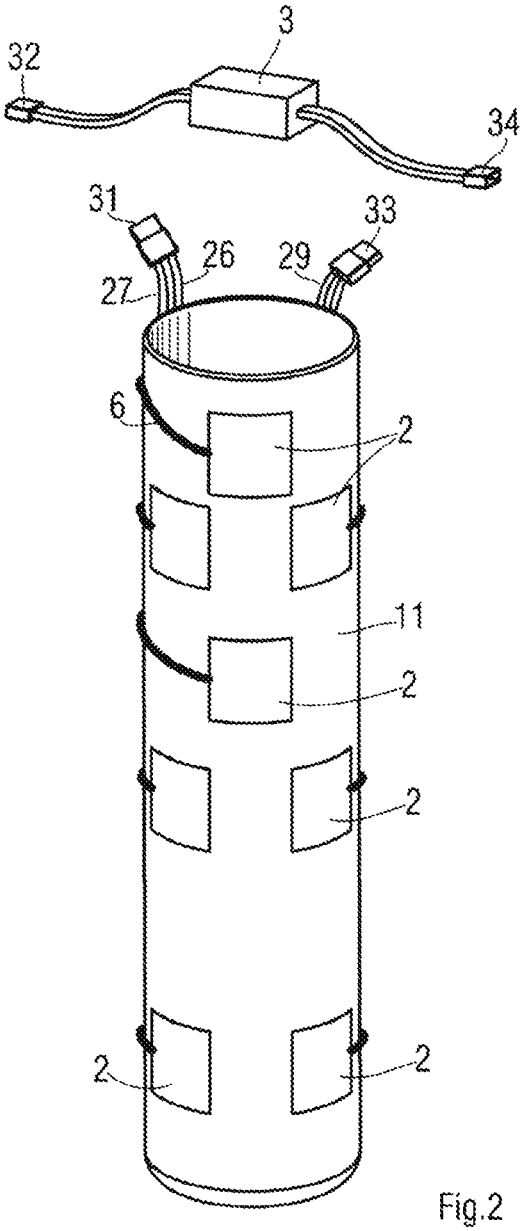
FIG. 2 is a view of the inner sheath of a device according to the invention.
Figure 3:
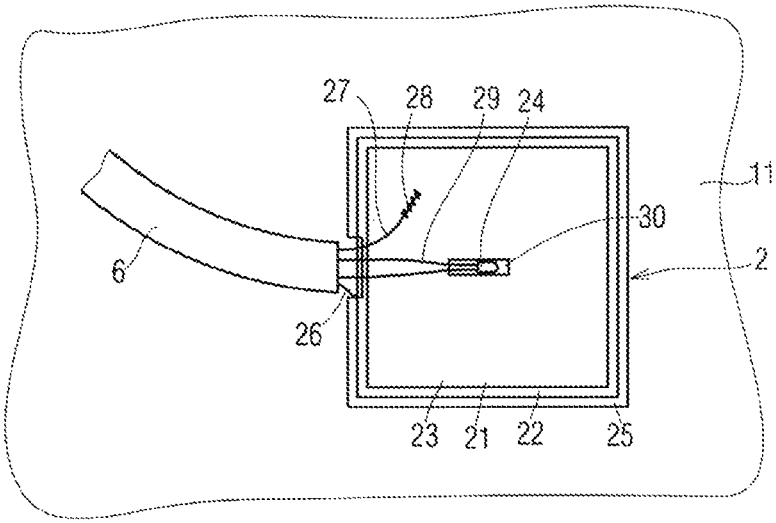
FIG. 3 is a representation of the inner sheath of a device according to the invention, comprising a target element.

The device comprises a plurality of target elements 2 attached to the inner sheath 11 represented in FIG. 2 (without the outer sheath 12 for clarity). The target elements 2 are structured in flexible sheets, i.e. thin and adopting the shaping of the bag, against which they are applied, once the device is installed. In other words, they are placed between the two sheaths, without forming notable excess thickness by the user, especially since they are flattened and by curving against the inner sheath 11, by the simple bearing of the outer sheath 12. Eight target elements are, in this case, disposed at a distance from one another, in three groups, the placements of which correspond to the parts of the body of an opponent (head, chest, legs).

Each target element 2 comprises a pressure sensor 2. The pressure sensors themselves structured in flexible sheets, are manufactured using a pressure-sensitive electrically conductive material film 22, sandwiched between two conductive sheets 23 which are electrically connected to the electronic control unit 3. The conductive film 22 is constituted of Lingstat™ film, the resistance of which varies in inverse proportion of the pressure that it undergoes. In other words, a hit dealt on this material will lead to a decrease of the resistance of the film 22, and the passage of a current between the two metal sheets 23, is all the more greater than the hit is strong. Thus, the signal generated is proportional to the pressure exerted and provides quantitative information about the hits given by the user. In the present example, squares of Lingstat™ film 22 have been used, with a thickness of 0.12 mm and sides of 10 cm. The two conductive sheets 23 are constituted of polyester-coated copper and nickel microfiber conductive fabric, commercialized under the brand Nasafes™, with a thickness of 0.10 mm and sides of 8 cm. They are placed centered and sewn above and below the film 22, in contact with it. Each sheet 23 is connected to the electronic control unit by an electrical cable 26 for one, 27 for the other, the end of which is stripped over a few centimeters and sewn to the zigzag point 28 directly on the fabric, preferably in a corner of the sheets 23, such that the connection receives the least number of impacts as possible. The pressure sensors 2, once assembled, can be slid in a pocket 25 made of plastic material, for example made of flexible polyvinyl chloride, and attached sewn on the inner sheath 11 by a few series of points carefully distributed, for example, at the border of the film 22.

The two electrical wires 26 and 27 are connected to the electronic control unit 3, to which they arrive by circulating on the surface of the inner sheath 11 in a protective guiding tube 6. The tube 6, made of fabric or made of flexible plastic material, is held applied against the inner sheath 11 by a continuous or intermittent seam. A tube 6 is provided at the start of each target element 2, and all converge towards the electronic control unit 3. They are conveniently brought together in a spindle 31 making it possible to connect and disconnect the bundle of electrical wires 26 and 27 of one single movement to the electronic control unit 3 via a port 32 which can receive this spindle.

The electronic control unit 3 comprises means for receiving data coming from each of the sensors 21 (raw data). It is provided with an electronic board comprising an analogue converter, such that the electrical signal received from a sensor, proportional to the pressure exerted, is transformed into quantitative data. The electronic control unit 3 also comprises means for processing the data received. This processing is generally a rather easy preprocessing, which can consist, in particular, of associated each pressure value with the reference of the sensor in question, with a time marked with respect to an initial time or with respect to the time for receiving the preceding pressure value on any of the sensors or on the same sensor.

The electronic control unit 3 also comprises means for transmitting raw data and/or the results of the preprocessing performed on a more developed external system, thanks to a wireless communication electronic module. The external system is able to receive and record the raw or preprocessed data transmitted by the electronic control unit 3. It is also able to provide complex analyses of data, to compare them with previously recorded reference data, and to perform a whole series of operations which are useful to users.

The electronic control unit 3 further integrates a supply means, such as a rechargeable battery having a life of several hours, preferably of at least 8 hours and even better, at least 12 hours. A charge indicator can be seen, either on the unit itself, or on a display screen of the external system. A signal alerting low charge, visual or sound, can also be installed. The rechargeable battery can be chargeable in situ, or it can be a removable accumulator, which can be replaced or recharged outside of the unit.

Example 2

The device presented in example 1 can be produced according to a variant, wherein the user is guided in their training sessions by light signs appearing on the punching bag. In this example, the target elements 2 each comprise a light emitter 24, which is electrically connected to the electronic control unit 3. In this case, light-emitting diodes (LEDs) are used, chosen with a sufficient power to be through the fabric of the outer sheath 12. They are attached to the center of one of the sheets 23 of the target elements 2 by a seam or another means, and are covered with a small transparent cap 30, in order to protect them from impacts, but also to protect the outer sheath 12. They are electrically connected to the electronic control unit 3 by cables 29, which circulate from each target element 2 through the tubes 6 described above. The cables 29 are assembled in a bundle, which is connected via a connecting spindle 33 engaging with a port 34 provided on the electronic control unit 3.

The illumination of the light emitters is commanded from the external system according to a sequence which can be selected by the user from an interface, for example on a touchscreen, in a prerecorded sequence database. The color of the light emitted can be modified by way of a suitable application.

The LED command means are coupled with the means for processing the data coming from the pressure sensors, and the external system is configured to compare the parameters of the light sign sequence and the data received relating to the pressures (raw data and prerecorded data) to perform the analysis of the sessions, with, for example, functions such as:

monitor function (speed, power),
timing (speed, endurance),
predefined sequences (technical exercises).

The punching bag thus becomes literally interactive.

Example 3

The external system is designed to offer, in association with the connected cover described in the preceding examples, of multiple functionalities, which are intended for users, both amateur and professional sportspeople, to their trainers or to boxing gym providers. Users have access to these functionalities and to mobile apps installed on the external system (compatible with Apple and Android), by way of a screen and command keys (physical or touchscreen keyboard). The external system can, in particular, be a web platform, a smartphone, a computer or a tablet.

The processing of data collected by the sensors is done by translating these data into numerical values measuring three parameters: power, speed, accuracy. The subsequent analysis is performed by an application configured to quantify:

The power of an impact and its accuracy;
The quantity of effort over a session;
The speed of executing a sequence;
The effectiveness of a technique;
The quality of a training session;
The progression through training sessions.

The analysis data and results are recorded, which offers the option of comparing the performances from one session or one season to another.

The external system can be configured to offer different methods and configurations as desired, in particular:

- controlling the correct operation of the sensors and LEDs during the connection and status report to the external unit;
- automatic standby;
- recovery of values coming from the sensors and sending in real time to the smartphone connected by Bluetooth;

execution of an LED illumination sequence, controlled from the smartphone.

In a variant of an embodiment, it is possible to configure the colors of the target LEDs being illuminated via a program sent by the smartphone. In this case, RGB diodes are attached to the target elements (with the corresponding cabling). The interest of this arrangement is to indicate by a predefined color that the weapon must hit the target in question.

Numerous actions can be controlled from the external system, by a mobile app which can be downloaded onto a smartphone, such as:

- user/web platform synchronization (avatar, statistics, preferences);
- authorization of use via a digital key provided by the web platform;
- creation of their user profile;
- management of program sequence;
- management of rest time between two training sessions;
- recording of a sequence executed on the punching bag and sending onto the web platform;
- option of operating in offline web mode;
- subscription to training programs.

Example 4

An interconnected assembly composed of several punching bags, each fitted with a connected cover 1 and a connected unit 3, is configured to operate in an interactive network, thanks to a web platform offering numerous options and, in particular, to:

- create their user profile;
- subscribe to training and coaching programs;
- take part in challenges;
- create programs (partition over three possible criteria: type of hits, color code indicating the body weapon to use on a target, time between 2 hits);
- share created programs;
- view their statistics.

This list is non-exhaustive. Multiple other functionalities can be provided and added to develop the extent of the options offered.

The invention claimed is:

1. A device intended to be fitted on a punching bag for training in striking combat sports comprising a cylindrical body covered with an envelope and fasteners for attaching the cylindrical body in a vertical position, the device comprising:

- a cover which has a tubular body, and dimensions defining an inner volume configured to contain said punching bag envelope, the cover being formed of two sheaths, one inner and one outer placed on top of one another, said cover comprising an end closed by a circular bottom attached to said tubular body and another end provided with an adjustable and releasable link to securely fix said cover to said punching bag;
- a plurality of target elements attached between the two sheaths, each comprising at least one pressure sensor electrically connected to an electronic control unit, each target element being covered by a protective pocket, said at least one pressure sensor of each target element being connected to said electronic control unit by electrical wires which are slid in a tube held applied against said inner sheath of said cover;
- an electronic control unit comprising a processor configured to receive and process data from said at least one pressure sensor of each target element; and
- an external system configured to receive the data from said electronic control unit and analyze the received data.

2. The device according to claim 1, wherein each target element further comprises at least one light emitter electrically connected to the electronic control unit.

3. The device according to claim 2, wherein the external system is a central unit of a laptop, a mobile phone provided with an embedded microprocessor, or a web platform, the external system comprising means for wirelessly communicating with the electronic control unit, and configured to execute one or more applications for assisting in striking combat sports training.

4. The device according to claim 3, wherein the one or more applications for assisting in striking combat sports training is selected from a group consisting of:

- an application considering parameters of power, speed and accuracy of each impact on each target element of the plurality of target elements during a session,
- an application considering variations of power, speed and accuracy of each impact on each target element of the plurality of target elements between sessions staggered over time,
- an application activating said light emitters of the plurality of target elements according to different sequences,
- an application comparing activation sequences of said light emitters of the plurality of target elements and parameters of power, speed and accuracy of impacts on corresponding target elements during a session,
- an application comparing performances of a user with a champion, other people taking part or with themselves at different times, and
- an application providing training programs.

5. The device according to claim 2, wherein the external system comprises a light emitter controller for commanding said at least one light emitter of each target element, said light emitter controller being coupled with the processor of the electronic control unit.

6. The device according to claim 2, wherein the electronic control unit is provided with i) at least one pin for connecting to said pressure sensors and said light emitters of the plurality of target elements, ii) a wireless communication electronic module and iii) means for electrically powering said electronic control unit.

7. The device according to claim 1, wherein said plurality of target elements are structured in flexible sheets, each comprising said at least one pressure sensor to deliver an electrical signal proportional to a pressure exerted on it.

8. The device according to claim 7, wherein said at least one pressure sensor of each target element is formed of an electrically conductive material film, the resistance of which varies in inverse proportion to the exerted pressure, said film being placed between two conductive sheets electrically connected to said electronic control unit.

9. The device according to claim 1, wherein the plurality of target elements are secured to the inner sheath at a distance from one another, by an attachment means selected from a group consisting of: a seam, a welding, an adhesive, a scratch band, and combinations thereof.

10. A punching bag for striking combat sports training comprising: a cylindrical body covered with an envelope and fasteners for attaching the cylindrical body in a vertical position, wherein the punching bag is fitted with the device of claim 1.

* * * * *